US006966090B2

(12) United States Patent
McClintock et al.

(10) Patent No.: US 6,966,090 B2
(45) Date of Patent: Nov. 22, 2005

(54) AIR MATTRESS WITH QUILTED PILLOW TOP

(75) Inventors: Jason McClintock, Wichita, KS (US); Andrew T. Metzger, Belle Plaine, KS (US)

(73) Assignee: The Coleman Company, Inc., Wichita, KS (US)

( * ) Notice: Subject to any disclaimer, the term of this patent is extended or adjusted under 35 U.S.C. 154(b) by 8 days.

(21) Appl. No.: 10/932,441

(22) Filed: Sep. 2, 2004

(65) Prior Publication Data

US 2005/0022307 A1 Feb. 3, 2005

Related U.S. Application Data

(63) Continuation-in-part of application No. 10/897,457, filed on Jul. 23, 2004, which is a continuation-in-part of application No. 10/794,602, filed on Mar. 6, 2004.

(60) Provisional application No. 60/467,793, filed on May 1, 2003.

(51) Int. Cl.[7] ..... A47C 27/08

(52) U.S. Cl. ..... 5/706; 5/655.4; 5/502; 5/911

(58) Field of Search ..... 5/706, 502, 655.4, 5/911, 702, 710, 413 A, 707, 709, 711, 712, 5/713, 655.3

(56) References Cited

U.S. PATENT DOCUMENTS

| | | | | |
|---|---|---|---|---|
| 3,034,132 A | | 5/1962 | Lansberger et al. | |
| 3,459,179 A | * | 8/1969 | Olesen | 601/134 |
| 3,780,388 A | | 12/1973 | Thomas et al. | |
| 4,055,866 A | * | 11/1977 | Evans | 5/655.4 |
| 4,181,990 A | | 1/1980 | Santo | |
| 4,371,999 A | | 2/1983 | Reid | |
| 4,424,600 A | | 1/1984 | Callaway | |
| 4,435,864 A | | 3/1984 | Callaway | |
| 4,449,261 A | * | 5/1984 | Magnusson | 5/722 |
| 4,541,135 A | | 9/1985 | Karpov | |
| 4,547,919 A | | 10/1985 | Wang | |
| 4,549,323 A | | 10/1985 | Brockhaus | |
| 4,604,765 A | | 8/1986 | Schultz | |
| 4,823,417 A | | 4/1989 | Fukuichi | |
| 5,005,236 A | * | 4/1991 | Hutchinson | 5/413 AM |
| 5,289,602 A | | 3/1994 | Trader | |
| 5,421,044 A | | 6/1995 | Steenson | |
| 5,493,742 A | * | 2/1996 | Klearman | 5/423 |
| 5,564,141 A | | 10/1996 | Anderson | |

(Continued)

FOREIGN PATENT DOCUMENTS

GB 2177292 A 1/1987

(Continued)

OTHER PUBLICATIONS

Simmons®, Beautyrest—HealthSmart™, *Slumberland Furniture,* 3pp.

(Continued)

*Primary Examiner*—Alexander Grosz
(74) *Attorney, Agent, or Firm*—Leydig, Voit & Mayer, Ltd

(57) ABSTRACT

An air mattress with a pillow top is disclosed. The pillow top is received on and extends at least partially across at least one of planar face of the mattress, and is constructed and arranged to be held in a fixed position relative to the face of the mattress on which it is received. The pillow top may be removably or permanently affixed to the air mattress, as desired.

The pillow top is configured to include bead channels, each bead channels having wide portions and narrow portions, the narrow portions and the beads being sized so as to limit travel of the beads between adjacent wide portions.

17 Claims, 6 Drawing Sheets

U.S. PATENT DOCUMENTS

| | | | | |
|---|---|---|---|---|
| 5,598,593 | A | | 2/1997 | Woffe |
| 5,608,931 | A | | 3/1997 | Gancy |
| 5,729,840 | A | | 3/1998 | Wu |
| 5,746,873 | A | | 5/1998 | Graf |
| 5,815,865 | A | | 10/1998 | Washburn et al. |
| 5,852,839 | A | | 12/1998 | Gancy |
| 5,855,033 | A | | 1/1999 | Frissen et al. |
| 5,991,949 | A | | 11/1999 | Miller, Sr. et al. |
| 6,016,582 | A | | 1/2000 | Larson |
| D420,780 | S | | 2/2000 | Cox et al. |
| 6,052,851 | A | | 4/2000 | Kohnle |
| 6,058,536 | A | * | 5/2000 | Henry ..... 5/691 |
| 6,073,291 | A | | 6/2000 | Davis |
| 6,076,214 | A | | 6/2000 | Klimenko |
| 6,115,861 | A | | 9/2000 | Reeder et al. |
| 6,161,231 | A | | 12/2000 | Kraft et al. |
| 6,233,764 | B1 | | 5/2001 | Orr |
| 6,321,400 | B1 | | 11/2001 | Gulino |
| 6,378,152 | B1 | | 4/2002 | Washburn et al. |
| 6,393,640 | B1 | | 5/2002 | Dalis |
| 6,460,209 | B1 | | 10/2002 | Reeder et al. |
| 6,463,610 | B1 | | 10/2002 | Shulte et al. |
| 6,618,884 | B1 | | 9/2003 | Wu |
| 6,643,875 | B2 | | 11/2003 | Boso et al. |
| 6,675,414 | B2 | | 1/2004 | Lamke |
| 6,739,002 | B1 | | 5/2004 | Pannu |
| 2002/0124320 | A1 | | 9/2002 | Washburn et al. |
| 2002/0133879 | A1 | | 9/2002 | Smith et al. |
| 2002/0178503 | A1 | | 12/2002 | Reeder et al. |
| 2003/0019037 | A1 | | 1/2003 | Michaelis et al. |
| 2003/0028972 | A1 | | 2/2003 | Michaelis et al. |
| 2003/0188388 | A1 | | 10/2003 | Boso et al. |

FOREIGN PATENT DOCUMENTS

| | | |
|---|---|---|
| WO | WO 90/07891 | 7/1990 |

OTHER PUBLICATIONS

Sofi, *Sofi Bead Pillow,* 3 pp., (Copyright 2004, Linens 'n' Things printed at <http://www.lnt.com/product/index.jsp?productid=1807703&cp=1331609.1331966&parentPage=family> on Sep. 8, 2004.

Mogu, *Mogu "The Original" Pom-Pom Pillow,* (2004, Healthy Back) printed at <http://www.healthyback.com/store/working/mogupillow.htm> on Sep. 8, 2004.

* cited by examiner

AIR MATTRESS WITH QUILTED PILLOW TOP

CROSS REFERENCE TO RELATED APPLICATION

This patent application is a continuation-in-part of U.S. patent application Ser. No. 10/897,457, filed Jul. 23, 2004, which is a continuation-in-part of U.S. patent application Ser. No. 10/794,602, filed Mar. 6, 2004, which claims priority to U.S. provisional Patent Application No. 60/467,793 filed May 1, 2003, all of which are incorporated herein in their entireties.

TECHNICAL FIELD OF THE INVENTION

The invention relates in general to air mattresses or beds. More particularly, the present invention relates to an air mattress or bed having a padded pillow top provided as a part thereof.

BACKGROUND OF THE INVENTION

The use of air beds or air mattresses is well known, and includes the use thereof as a camping bed or mattress as well as for use in recreational pursuits, for example at the beach or poolside, or as temporary bedding for travelers and house guests. In order to make usage of the air mattress more comfortable as the user's skin may stick to the vinyl or plastic used to form the mattress, it is oftentimes desirable to shield or cover the face of the air mattress on which the user lies or reclines so as to insulate the user from the vinyl or plastic material of the air mattress. This is often done by placing a sheet or pad of some type on the sleeping surface or face of the air mattress. This may comprise, for example, a sleeping bag, a fitted sheet, or a conventional bed sheet placed on or about the air mattress.

A common problem that typically arises, no matter what type of padding or sheet is used, however, is that the air mattress size and shape likely varies from "standard" non-air mattress sizes such that conventional fitted or plain hemmed sheets will not fit well on the mattress. For example a fitted sheet of known construction tends not to stay wrapped about or received on an air mattress as air mattresses are typically sized smaller than a corresponding mattress size, for example a single or a full sized mattress, so that the fitted sheets still fit loosely about the air mattress and tend to be pulled off of the air mattress during use.

Additionally, most air mattresses are formed of a smooth-surfaced plastic material to which cloth sheets or sleeping bags will not adhere, such that the sleeping bag or sheets will slide on or over the air mattress rather than stay wrapped thereabout. Moreover, the size and shape of air mattresses, and in particular the face and perimeter wall portion thereof, tend to vary as the user moves on the mattress due to the compressibility of the air within the mattress and the flexibility of the mattress face and sidewall such that any padding or cover placed thereon tends to move or slide off of the mattress surface with the movements of the user.

One common example of a type of padding used on an air mattress, resorted to by a great many users, is to place a conventional sleeping bag on the mattress. Although sleeping bags are well padded, they are not generally adapted to be fit to, on, or about an air mattress, with the result that the sleeping bag moves or travels on or over the surface of the mattress during use. Also, sleeping bags may tend to be too thickly padded such that when used with an air mattress in a warm weather environment, the user may become too hot and thus sleep poorly or restlessly.

What is needed, therefore, but seemingly unavailable in the art, is an air mattress having a padded covering which may be placed on at least the sleeping surface or face of an air mattress and which will remain positioned on, i.e., resist movement off of, the air mattress during use.

SUMMARY OF THE INVENTION

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

The present invention provides an air mattress or air bed with a cloth or padded cloth pillow top received on at least the sleeping surface or face of an air mattress or bed, and which overcomes some of the design deficiencies of the known art.

In a first embodiment, the invention discloses an air mattress or bed having a padded pillow top that may be removably affixed to the mattress or otherwise retained on at least the sleeping surface or face of the mattress. The pillow top may itself comprise a cloth sheet, and may further comprise a padded or quilted natural or synthetic fabric or cloth material, or a non-woven material or covering, as desired.

The pillow top is formed so as to be removably, or detachably, held in position relative to the sleeping surface of the air mattress once mated thereto such that during usage of the air mattress with the pillow top of the invention, the pillow top remains on the mattress rather than moving on, over, and possibly off of the mattress.

In a second embodiment, an air mattress or bed is disclosed having a permanently affixed pillow top mated to or otherwise retained on at least the sleeping surface of the air mattress.

A method of affixing or securing a cloth pillow top to at least the sleeping surface of an air mattress is also disclosed by the present invention, which method comprises forming or placing a first fastener member at least partially along the lengthwise direction of a side or the peripheral edge of at least one face of the mattress, forming or placing a second corresponding fastener member at least partially along the lengthwise direction of a side or a peripheral edge of the pillow top, and selectively engaging the first and second fastener members to one another for securing the pillow top on the sleeping surface of the air mattress. The method may also comprise positioning, holding, or securing the pillow top in a fixed position relative to the sleeping surface of the air mattress.

In accordance with an embodiment, a sleeve is provided at the top of an airbed for receiving a pillow top mattress or other type of mattress. In accordance with an embodiment, the pillow top mattress is a memory foam mattress or topper. The sleeve may be, for example, a cover that zips to the top of the airbed or may attach in another suitable manner.

Other features of the invention will become apparent from the following detailed description when taken in conjunction with the drawings, in which:

DETAILED DESCRIPTION

In the following description, various embodiments of the present invention will be described. For purposes of explanation, specific configurations and details are set forth in order to provide a thorough understanding of the embodiments. However, it will also be apparent to one skilled in the art that the present invention may be practiced without the specific details. Furthermore, well-known features may be omitted or simplified in order not to obscure the embodiment being described.

Figure 1:
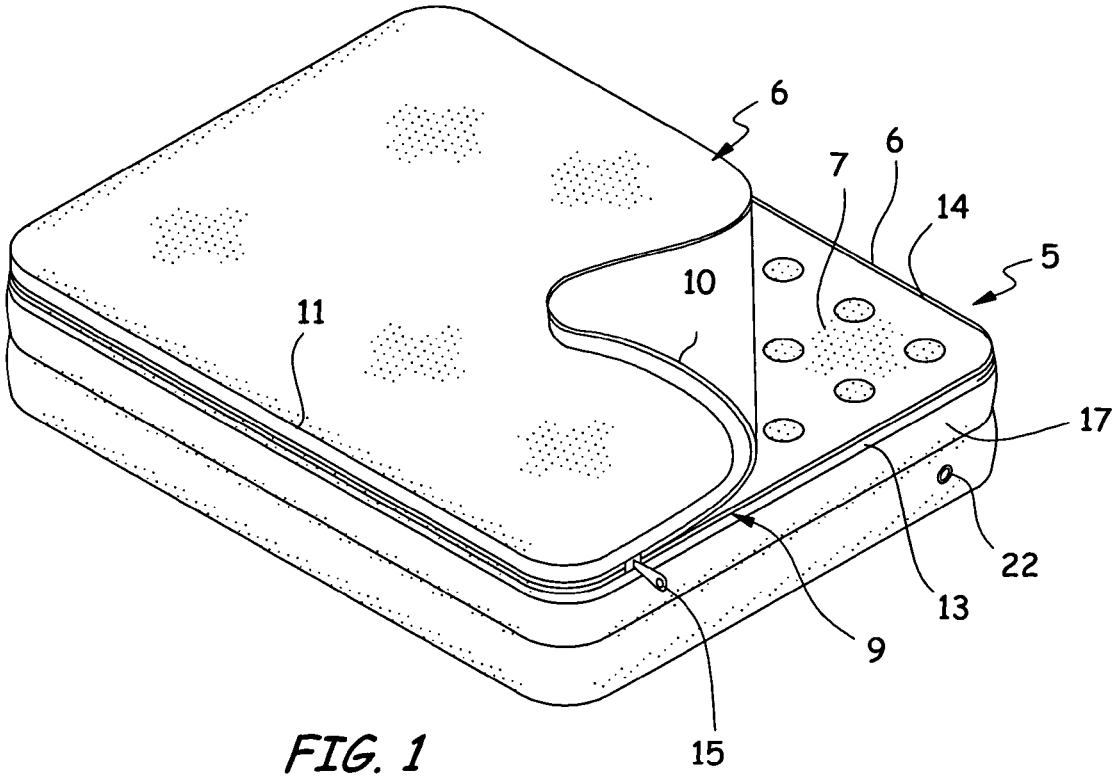
FIG. 1 is a perspective view of a first embodiment of the invention illustrating a pillow top constructed to be removably affixed to an air mattress or bed.
Figure 2:
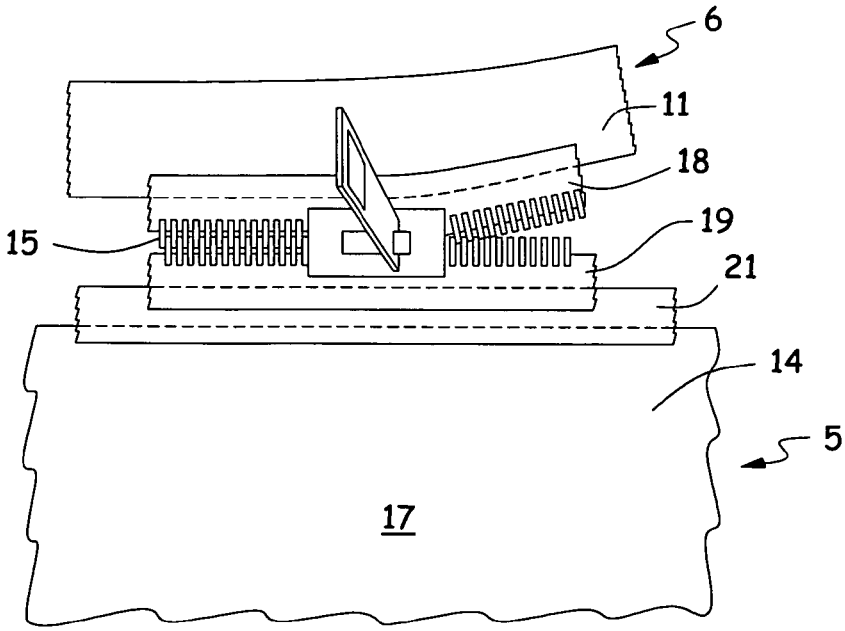
FIG. 2 is an enlarged partial view of a zipper fastener member extended along two respective side edges of the pillow top and an air mattress illustrating a manner in which the pillow top may be attached or secured to the air mattress.
Figure 3:
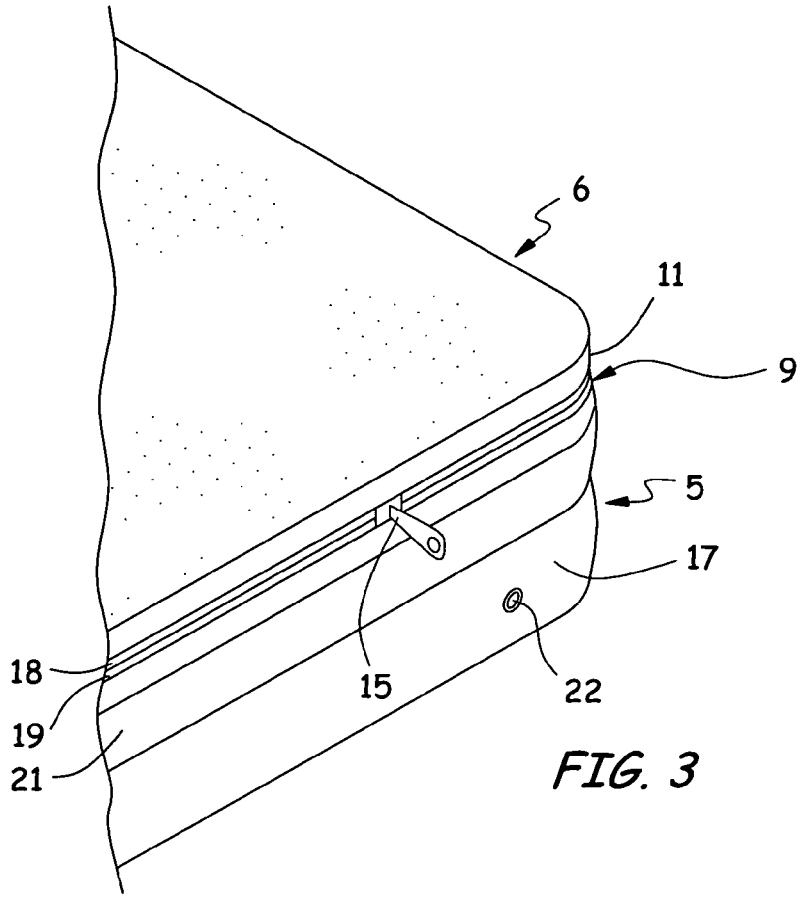
FIG. 3 is a partial and enlarged perspective view of a removable pillow top received on an air mattress.

Referring now to the drawings, in which like reference numerals represent like parts throughout the several views, an air mattress 5 with a fabric pillow top 6 received on or across at least a portion of a sleeping surface or face 7 defined on and by the mattress is illustrated in FIG. 1. The pillow top illustrated in FIGS. 1–3 is constructed and arranged to be removably positioned, secured, or affixed to, on, or across the face of the air mattress such that he pillow top will be held in a"fixed" position relative to the sleeping surface of the mattress or bed. As is apparent to those skilled in the art, as both the air mattress and the pillow top are formed of flexible materials, each will tend move with respect to the other during use of the air mattress and pillow top by a user (not illustrated). What is intended by describing the pillow top of the invention as being"fixed" relative to the face of the air mattress is that although the pillow top may partially slide on or over portions of the face of the air mattress, the pillow top will not, however, slide off of either the face of the mattress, or off of the mattress itself and will remain substantially in position thereon.

The pillow top 6 preferably comprise a padded pillow top attached to a conventional and standard sized air mattress or bed, respectively, by forming or placing a fastener member 9 along at least a portion of a side or a peripheral edge portion of the pillow top, and along at least a portion of the side or peripheral edge portion of the air mattress. The pillow top may be formed of a natural or a synthetic fabric or cloth material, or may be formed of a non-woven material, as desired.

In accordance with one embodiment, the pillow top 6 is formed of memory foam. As is further described below, memory foam is a pressure sensitive or temperature sensitive polyurethane foam that has the ability to compress, but then slowly come back to its original shape. Therefore memory foam does not place nearly the same resistance on the joints as spring, air, and other materials that bounce back more rapidly.

Referring now to FIGS. 2–3, a first fastener member 10 is formed, positioned, or placed along at least a portion of the side or peripheral edge portion 11 of the pillow top, and a second fastener member 13 is formed, positioned, or placed along at least a portion of the corresponding side or peripheral edge portion 14 of at least one face, preferably the face 7, of the air mattress.

For example, the first and second fastener members may each be formed as the corresponding portions of an elongate zipper 15 of known construction, as illustrated in FIGS. 1–3. The zipper 15 is shown extended at least partially along the length of the continuous peripheral side edges 11, 14 defining the boundaries of the face 7 of the pillow top and of the air mattress 5, extended generally along the length of the peripheral sidewall 17 bounding the air mattress and forming the air chamber (not illustrated) between the face 7 and a second bottom face (not illustrated) of the air mattress, as known. The air mattress is provided with an air inlet 22 of known construction.

Although the fastener member is shown as a zipper in a first embodiment, other suitable fasteners, for example hook and loop fasteners, mechanical; or magnetic snaps, or buttons and button eyelets may be used as the fastener member 9. Where the fastener member comprises a zipper, the zipper may preferably comprise a number five zipper, as known to those skilled in the art, to ensure adequate fastener strength while maintaining a small enough size to prevent adversely affecting the comfort of the air bed or mattress user. The zipper 15 may thus be formed as a toothed zipper, or as a continuous pliable zipper having a continuous raised elongate first or male member adapted to be received in a continuous recessed or groove-like elongate second or female member formed, for example, as are the zippers of resealable plastic sandwich and snack bags and the like.

As shown in FIG. 2, a first portion or half 18 of the zipper is attached to the pillow top in at least two spaced locations along the side edge 11 of the pillow top. Preferably, the portion 18 of the zipper, or zipper tape as also known to those skilled in the art, is sewn or otherwise permanently affixed to, i.e., extends along, all four sides of the edge 11 of the pillow top. The second portion or half 19 of the zipper may similarly be sewn or otherwise permanently affixed to a length of fiber, to include nylon and other suitable natural or synthetic fibers, reinforced polyvinylchloride ("PVC") edge strip or tape 21 which is itself welded, heat fused, or formed as a portion of the mattress 5, or the edge portion 14 thereof. The preferred location of the weld for the tape 21 is on the outside of the existing edge weld of the air mattress as conventionally formed, with the second portion of the zipper extending at least partially along, and preferably along the entirety of, the length of the existing mattress side edge weld. By forming or assembling the zipper 15 in this manner, a strong and durable faster member is provided, yet one which will be relatively unobtrusive to the mattress user during use of the mattress.

Figure 4:
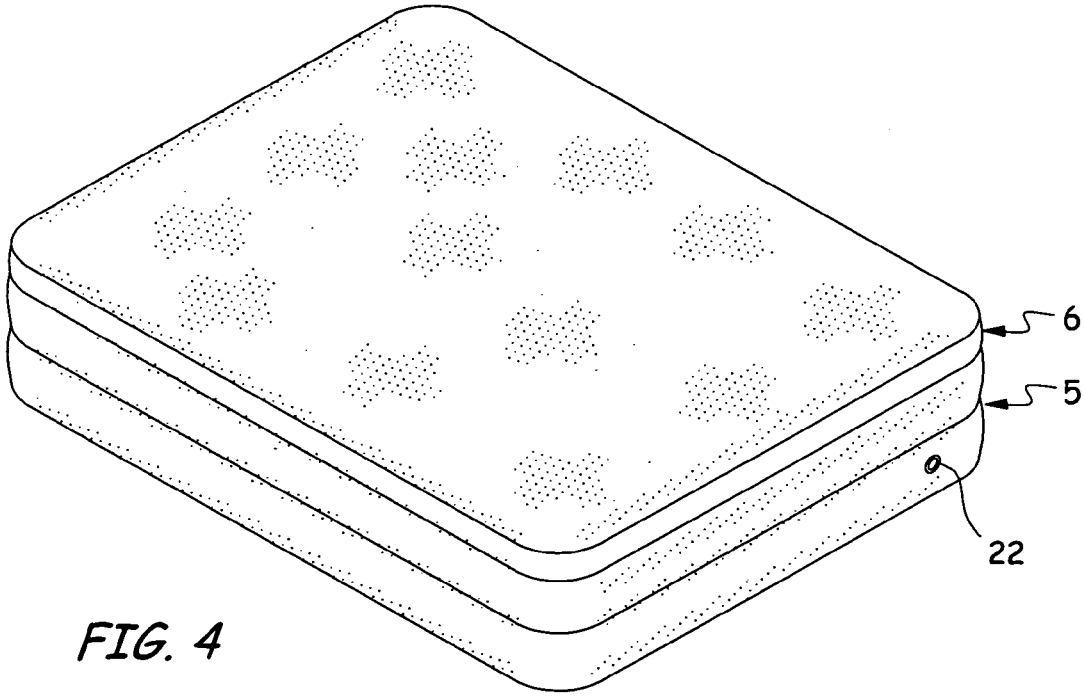
FIG. 4 is a is a perspective view of a second embodiment of the invention illustrating a pillow top which is permanently affixed to an air mattress or bed.

In a second embodiment, as illustrated in FIG. 4, the pillow top 6 may be sewn or edge welded directly to the tape 21, thus eliminating the need for a zipper or other fastener member. The benefit of fabricating the pillow top to have a side edge fastener member, for example the zipper 15, is that the use of the fastener member allows for the selective removal of the pillow top from the air mattress for cleaning, or as otherwise desired, for example for storage purposes. Also, the construction of the pillow top to be removable by use of the fastener member 9 allows for alternate pillow top materials, constructions, or styles to be placed on the air bed or mattress and also allows for the convenient laundering of the pillow top.

Figure 5A:
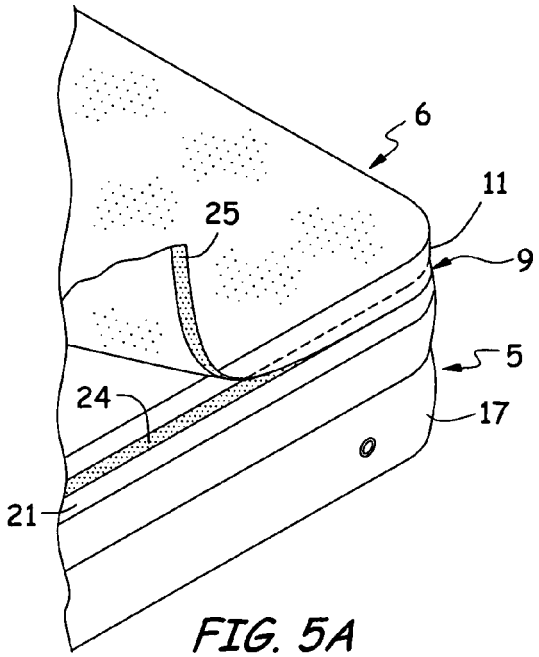
FIGS. 5A–C are three separate partial and enlarged vies of alternate fastening means for attaching the pillow top to the mattress, and include a hook and a loop fastener, a male-female snap fastener, and a button and an eyelet fastener, respectively.

Referring now to FIG. 5A, it is also contemplated that a hook and loop style of fastener member 9, for example a VELCRO® style fastener or alternately a mechanically formed hook and loop or eyelet, may be used to secure the pillow top to the mattress. This may be accomplished by using a length of a fiber reinforced PVC strip or tape, such as tape 21, welded or secured to, or otherwise formed as a part of the side edge of the mattress 5, with either the hook 24 or the loop 25 portion of the fastener affixed thereto or formed as a part thereof, and the corresponding loop 25 or hook 24 fastener portion, respectively, being formed or affixed to at least two spaced locations of the side edge portion 11 of the pillow top, or tops, 6. Preferably, the hook and loop fastener will extend along substantially the entirety of the length of the side edge of the pillow top and the side edge of the air mattress.

Figure 5B:
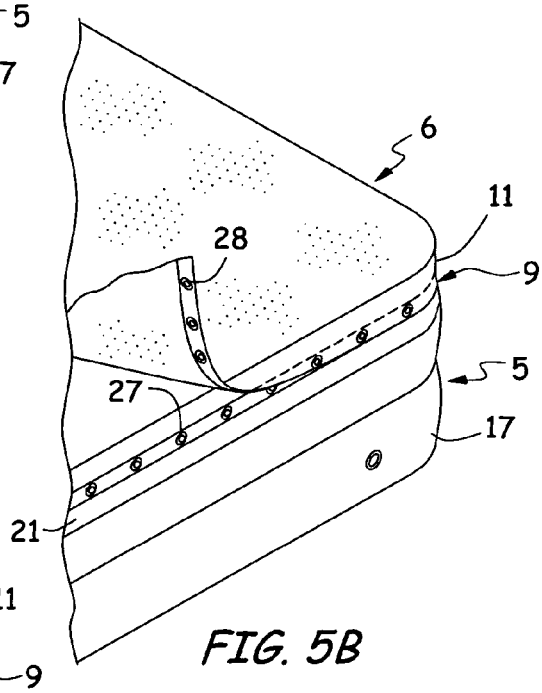
Figure 5C:
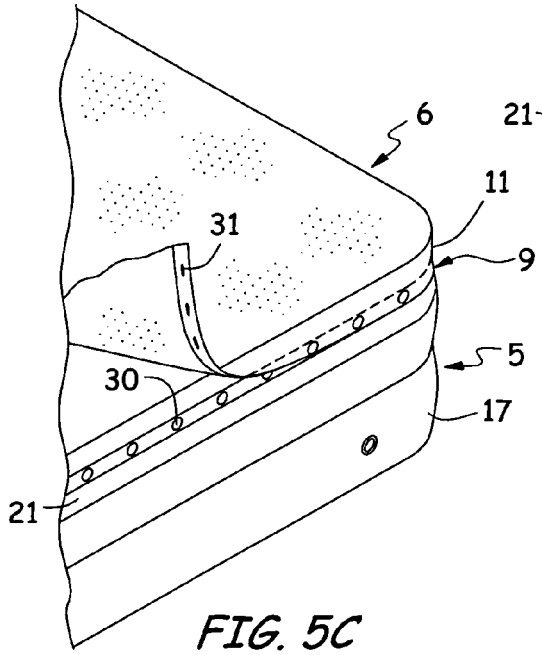

In addition to using a zipper or a hook and loop fastener as the fastener member 9, the fastener member may also be formed of mechanical or magnetic snaps of known construction as illustrated in FIG. 5B. As disclosed, a male snap member 27 and a corresponding female snap member 28 are positioned along the length of the pillow top and air mattress side edges 11, 14, respectively. Similarly, the fastener member may also comprise a series of spaced buttons 30 affixed to either the edge portion of the pillow top or the air mattress respectively, with the corresponding button eyelets 31 formed along the edge portion of the air mattress or pillow top, respectively, as illustrated in FIG. 5C.

The snaps, buttons and eyelets, and any other known types of fasteners desired to be used in joining the pillow top to the air mattress, may be formed on the tape 21 of the air mattress, and in, on, or along the edge portion 11 of the pillow top, as discussed above for the zippered embodiment of the fastener member.

One preferred embodiment of the fabric pillow top will preferably comprise a layer of a natural or a synthetic fabric batting material surrounded or sandwiched by or between two layers of a natural or a synthetic cloth fabric. It is preferred that the fabric pillow top be made in a quilted fashion, as known, in order to lock the batting in place. The fabric and batting material used can vary as desired, or as needed, for the expected service environment of the air mattress or bed. The batting used should have density and loft values great enough to ensure sufficient comfort and insulation levels to the user(s) of the mattress. The loft will preferably be greater than 1 mm, with a preference of 10 mm or more. The preferred density of the batting should be in the range of 100 g/m$^2$.

In a further embodiment, the pillow top 6 is permanently affixed to or otherwise retained on at least the sleeping surface 7 of the air mattress 5, as illustrated in FIG. 5. The edge portion 11 of the pillow top may be sewn directly to the tape 21 of the air mattress, or may be otherwise fused or heat welded to either the tape 21, or to the air mattress 5 directly, as desired.

A method of affixing or securing a pillow top to at least the sleeping surface or portion of an air mattress is also taught by the present invention. The method includes the steps of forming or placing a first fastener member at least partially along the lengthwise direction of the side or peripheral edge portion 11 of the pillow top, and forming or placing a second corresponding fastener member at least partially along the lengthwise direction of the side or peripheral edge portion 14 of the mattress, and selectively engaging the first and second fastener members with or to one another for removably securing or affixing the pillow top on, over, or across the face of the air mattress.

The steps of forming or placing the first and second fastener members may include extending a first zipper portion 18 along at least a portion of the length of the side edge of the pillow top, and extending a second zipper portion 19 along at least a corresponding portion of the length of the air mattress, whereupon the two zipper portions are mated to one another in known fashion to join or affix the pillow top to the air mattress. The steps of forming or placing the first and second fastener members may also include extending a first hook 24 or a loop 25 fastener member, a snap member 27,28, or a button 30 along at least a portion of the length of the side edge of the pillow top, and extending a second corresponding loop 25 or a hook fastener member 24, or a snap member 28,27, or a button eyelet 31 along at least a corresponding portion of the length of the air mattress.

Once "affixed" to the mattress, whether removably or permanently, the pillow top is held in a fixed position relative to the sleeping surface of the air mattress across which the pillow top is extended. The method may also therefore comprise the step of positioning, holding, or securing the pillow top in a fixed position relative to the sleeping surface of the air mattress.

Figure 6:
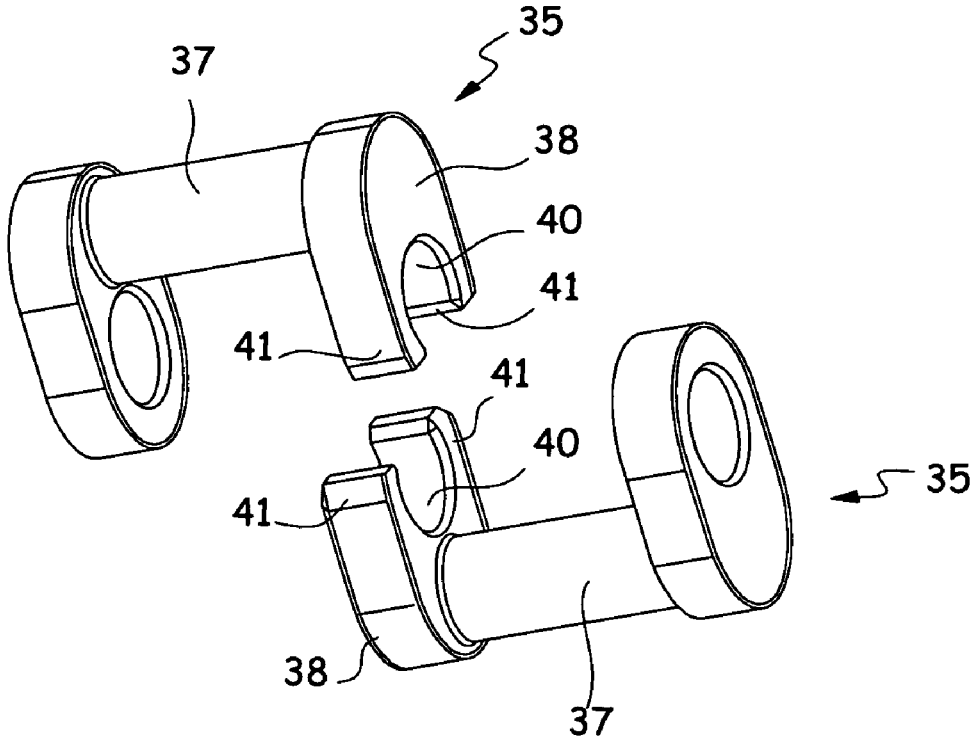
FIG. 6 is a perspective view of a pair of another fastener type adapted for use in attaching the pillow top to the mattress.
Figure 7:
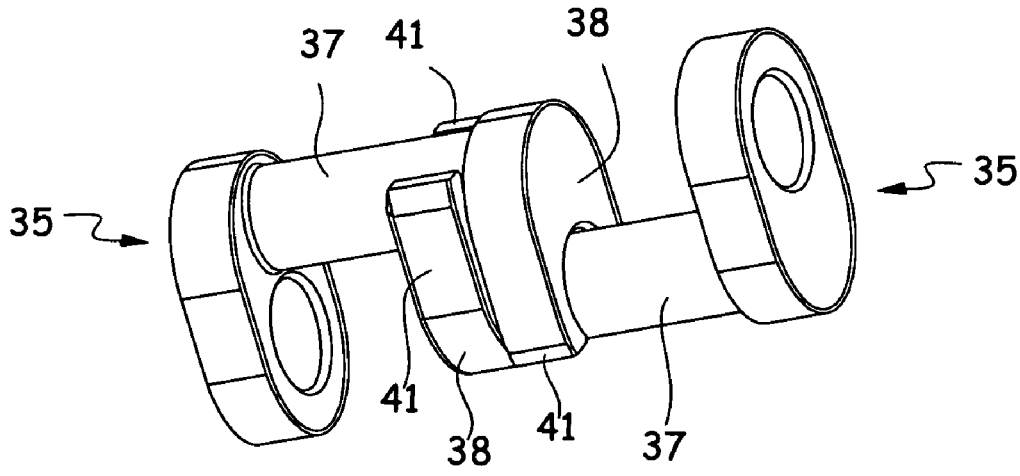
FIG. 7 is a perspective view of the fastener of FIG. 6 snap-fit or locked to one another.

Referring now to FIGS. 6 and 7, yet another type of fastener 35 suitable for use as the fastening means for fastening or securing the pillow top 6 to the underlying air bed or mattress 5 is illustrated. The fastener 35, also referred to herein as a line connector, is illustrated and described in greater detail in co-pending U.S. patent application Ser. No. 10/460,130, assigned to the Coleman Company, Inc., and filed in the United States Patent and Trademark Office on Jun. 12, 2003, titled Quick Connection Mechanism for Inflatables, the provisions of which are incorporated fully herein by this reference.

Each of the fasteners 35 of FIGS. 6 and 7 has a male portion 37 and a female portion 39. In the embodiment illustrated, the male portion comprises an elongate member, which member may optionally be formed as cylindrical in shape if so desired. The female portion 39 of the fastener comprises an opening 40 defined by a pair of bifurcated legs 41, and is sized and shaped to be yieldably urged over and about the male portion such that the female portion then snaps or locks itself at least partially about the male member of a corresponding fastener 35, as illustrated in FIG. 7. The fasteners 35 are each formed of a resilient material such that the female portions thereof return substantially to their original configuration (size and shape) once placed on and moved at least partially about the male portion of a corresponding fastener.

At least a first fastener 35, and preferably a series of spaced fasteners 35 will be suitably affixed to and extended at least partially along the perimeter of the pillow top 6, with at least a second corresponding fastener 35, or preferably a series of spaced fasteners 35, being suitably affixed to and extended along to the perimeter or edge portion 14 of the air mattress bounding or otherwise defining the face 7 thereof. The female portions of the respective fasteners will be placed on and moved at least partially about the male portion of a corresponding one of the fasteners, and the respective first and second fasteners then snap-fit or locked to one another.

Figure 8:
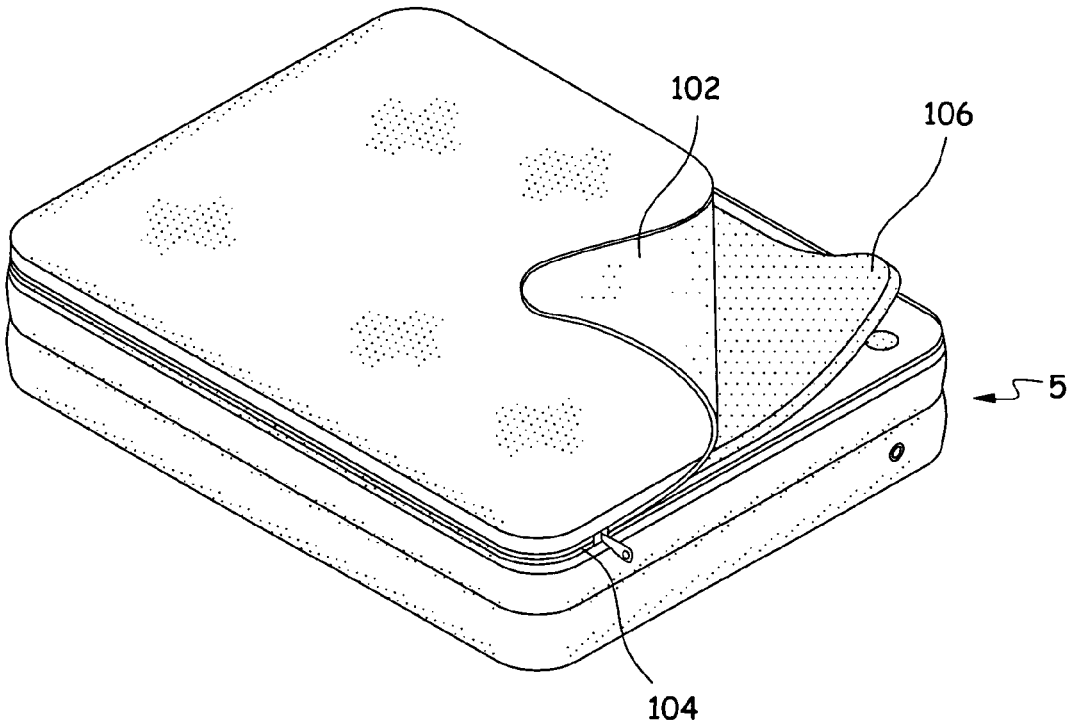
FIG. 8 is a perspective view of a memory foam mattress received in a sleeve of an airbed.

An alternate embodiment of a covering for the airbed 5 is shown in FIG. 8. In the embodiment shown in FIG. 8, a sleeve 102 is connected to the top of the airbed 5, for example by a zipper 104. The sleeve 102 may be connected in another manner, such as by hook and loop fasteners, snaps, buckles, ties, or another suitable structure, but preferably is arranged so that a mattress or topper 106 may be situated therein. In the embodiment shown in FIG. 8, the mattress or topper 106 is memory foam. Memory foam is a visco-elastic foam originally developed for NASA. One example of memory foam is TEMPUR-PEDIC foam. In general, memory foam is a pressure sensitive or temperature sensitive polyurethane foam that has the ability to compress, but then slowly return to its original shape.

The memory foam mattress or topper 106 may be sized to cover the entire airbed 5, or may be sized to provide support at one portion of the airbed 5, such as at a portion aligned with the torso of a user. Alternatively, the memory foam mattress or topper 106 may be positioned on one side of the airbed 5 so that only one user may use the memory foam mattress or topper 106. To this end, more than one sleeve 102 may be provided for receiving more than one memory foam mattress or topper 106.

Figure 9:
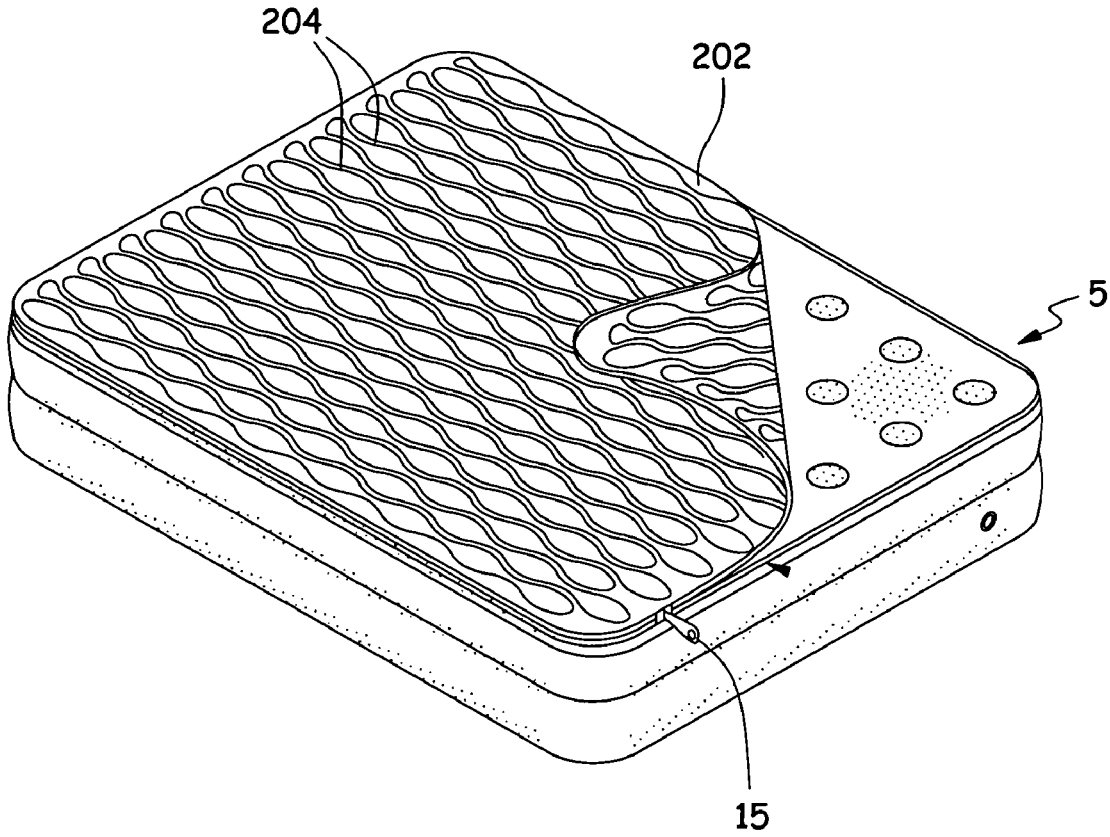
FIG. 9 is a perspective view of an airbed incorporating a quilted pillow top in accordance with an embodiment of the invention.

An alternate embodiment of a covering, in this case a quilted pillow top 202, for the airbed 5 is shown in FIG. 9. In the embodiment shown in FIG. 9, the quilted pillow top 202 is connected to the top of the airbed, for example by a zipper 104. The quilted pillow top 202 may be connected in another manner, such as by hook and loop fasteners, snaps, buckles, ties, or other suitable structures, some of which are described herein.

In the embodiment shown in FIG. 9, the quilted pillow top 202 includes upper and lower layers (best shown in FIG. 10) connected along quilting lines 204. Compressible beads 206, such as expanded polystyrene beads or polyester foam beads, are trapped between the upper and lower layers.

Figure 10:
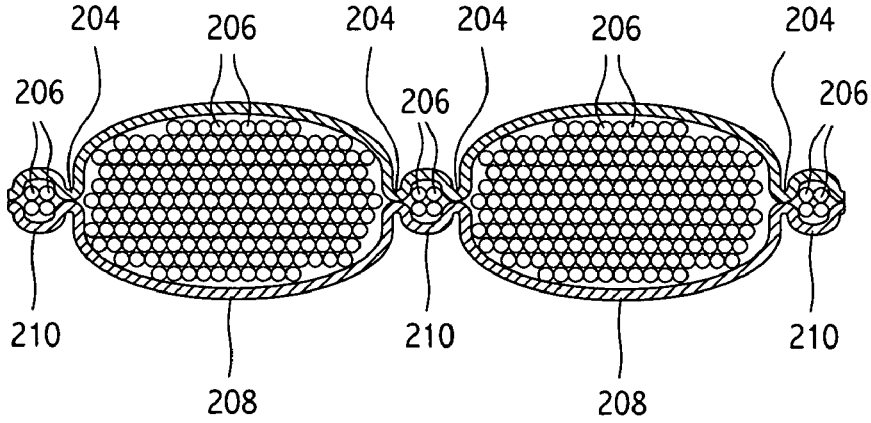
FIG. 10 is a partial section view of quilted pillow top of FIG. 9, the section taken perpendicular to a line extending from the head to the foot of the airbed.

In the embodiment shown, the quilting lines are arranged in sinusoidal patterns, with adjacent lines being offset 180 degrees relative to one another (i.e., inverted relative to one another), so that two adjacent lines form alternating narrow portions 210 (best shown in FIG. 10) and wide portions 208 (also best shown in FIG. 10). In general, the compressible beads 206 tend to stay in the wide portions 210, but some travel of the beads may occur through the narrow portions 208. In accordance with an embodiment, the narrow portions and the compressible beads 206 are sized so as to limit this travel. As such, the compressible beads 206 remain distributed over the quilted pillow top 202 even through wear or washing.

In an embodiment, the wide portions 210 are approximately 4.75 inches in diameter at a widest point, and the narrow portions 208 are approximately one inch across at a narrowest point. The compressible beads 206 for this embodiment are expanded polystyrene beads, and are approximately 0.028 to 0.033 in diameter. Other bead materials may be used, and may be compressible or not, and the sizes of the beads and/or the wide and narrow portions 210, 208 may be altered as needed for a desired effect. As an example, another material that may be used for the beads is polyester foam beads. Also, if desired, the bead size may be altered to provide different comfort levels. In addition, a single quilted pillow top 202 may include multiple different sized beads.

In accordance with an embodiment, the narrow portions 208 are arranged and configured to take into account the size of the compressible beads 206 and the friction of the quilted pillow top 202 so that limited travel of the beads is permitted between the wide portions. In this manner, the compressible beads remain somewhat evenly distributed over the quilted pillow top 202.

If desired, in an alternate embodiment, the narrow portions 208 may be closed so as to block any flow of compressible beads between two adjacent wide portions 210.

Although several embodiments of the invention have been disclosed in the foregoing specification, it is understood by those skilled in the art that many modifications and other embodiments in the invention will come to mind to which the invention pertains, having the benefit of the teaching presented in the foregoing description and the associated drawings. Moreover, the invention is not limited to the specific embodiments disclosed hereinabove, and any desired modifications and other embodiments are intended to be included within the scope of the invention.

Moreover, although specific terms are employed herein, they are used in the generic and descriptive sense only, and are not intended to limit the scope of the invention; and the words "a," "and," or "the" as they appear herein may mean one or more, depending upon the context in which the words are used, and are not otherwise intended to limit the scope of the disclosed invention.

Other variations are within the spirit of the present invention. Thus, while the invention is susceptible to various modifications and alternative constructions, a certain illustrated embodiment thereof is shown in the drawings and has been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. An air mattress, comprising;

a pair of spaced planar surface with a continuous side edge extending therebetween and joined to the respective planar surface to define at least one air chamber within the air mattress;

an air inlet for use inflating the at least one air chamber of the mattress; and a pillow top constructed and arranged to be received on and to extend at least partially across at least one of the planar surfaces of the mattress, the pillow top comprising a quilted pillow top with beads contained therein, the pillow top being configured to include bead channels, each bead channel having wide portions and narrow portions, the narrow portions and the beads being sized so as to limit travel of the beads between adjacent wide portions.

2. The mattress of claim 1, wherein the beads comprise compressible beads.

3. The mattress of claim 1, wherein the beads are expanded polystyrene beads.

4. The mattress of claim 1, further comprising a first fastener member positioned along a side edge of the mattress, and a second corresponding fastener member positioned on a side edge of the pillow top.

5. The mattress of claim 4, wherein said first and second fastener members together comprise a zipper.

6. The mattress of claim 4, wherein said first and second fastener members comprise at least one hook fastener and at least one loop fastener, respectively.

7. The mattress of claim 4, wherein said first and second fastener members comprise at least one button and at least one corresponding button eyelet, respectively.

8. The mattress of claim 4, wherein said first and second fastener members comprise at least one male snap member at least one corresponding female snap member, respectively.

9. The mattress of claim 4, wherein said first and second fastener members each comprise a magnet.

10. The mattress of claim 4, wherein said first and second fastener members each comprise a line connector.

11. The mattress of claim 1, wherein the quilted pillow top comprises stitching in quilting lines in a sinusoidal pattern to form the narrow portions and the wide portions.

12. The mattress of claim 11, wherein adjacent quilting lines are offset approximately 180 degrees relative to one another, so that two adjacent lines form alternating narrow portions and wide portions.

13. The mattress of claim 1, wherein the pillow top is removable received on said at least one of the planar surfaces of the mattress.

14. An air mattress, comprising;

a top potion; and a pillow top attached to the top portion, the pillow top comprising a quilted pillow top with beads contained therein, the pillow top being configured to include bead channels, each bead channel having wide portion and narrow portions, the narrow portions and the beads being sized so as to limit travel of the beads between adjacent wide portions.

15. The mattress of claim 14, wherein the quilted pillow top comprises stitching in quilting lines in a sinusoidal pattern to form the narrow portions and the wide portions.

16. The mattress of claim 14, wherein adjacent quilting lines are offset approximately 180 degrees relative to one another, so that two adjacent lines form alternating narrow portions and wide portions.

17. The mattress of claim 14, wherein the pillow top is removably attached to the top portion.

* * * * *